US005866268A

United States Patent [19]

Sargeant et al.

[11] Patent Number: 5,866,268

[45] Date of Patent: Feb. 2, 1999

[54] LIQUID SORPTIVE COATING FOR INK JET RECORDING MEDIA

[75] Inventors: Steven J. Sargeant, West Warwick, R.I.; Joshua Rundus, San Dimas, Calif.

[73] Assignee: Arkwright Incorporated, Fiskeville, R.I.

[21] Appl. No.: 912,477

[22] Filed: Aug. 18, 1997

Related U.S. Application Data

[63] Continuation-in-part of Ser. No. 527,719, Sep. 13, 1995, abandoned.

[51] Int. Cl.[6] ..... B41M 5/00

[52] U.S. Cl. ..... 428/532; 428/195; 428/211; 428/535; 428/537.5

[58] Field of Search ..... 428/195, 211, 428/481, 532, 535, 537.5

[56] References Cited

U.S. PATENT DOCUMENTS

| | | |
|---|---|---|
| 4,092,457 | 5/1978 | Fujita et al. . |
| 4,269,891 | 5/1981 | Minagawa . |
| 4,550,053 | 10/1985 | Arai et al. . |
| 4,555,437 | 11/1985 | Tanck . |
| 4,575,465 | 3/1986 | Viola . |
| 4,592,954 | 6/1986 | Malhotra . |
| 4,868,581 | 9/1989 | Mouri et al. . |
| 5,141,797 | 8/1992 | Wheeler . |
| 5,277,965 | 1/1994 | Malhotra . |
| 5,521,002 | 5/1996 | Sneed . |

FOREIGN PATENT DOCUMENTS

| | | |
|---|---|---|
| 02 86427A2 | 10/1988 | European Pat. Off. . |

OTHER PUBLICATIONS

Patent Abstracts of Japan, vol. 11, No. 21 (M–555) 21 Jan. 1987 (JP 61 193879 A)..

Patent Abstracts of Japan, vol. 11, No. 157 (M–590) 21 May 1987 (JP 61 287782 A).

*Primary Examiner*—Pamela R. Schwartz

*Attorney, Agent, or Firm*—Birch, Stewart, Kolasch & Birch, LLP

[57] ABSTRACT

The present invention is directed to an ink jet recording media containing a substrate having a liquid sorptive coating coated on a surface thereof. The liquid sorptive coating contains a hydroxyalkyl methylcellulose and at least one nitrogen-containing component. The hydroxyalkyl methylcellulose is preferably present in the coating in an amount of about 70 to about 98%, based on the amount of solids in the coating. The hydroxyalkyl methylcellulose also preferably has a hydroxyalkyl content of from about 3% to about 15%, preferably about 7% to about 12%, and a methoxyl content of from about 15% to about 28%, preferably about 19% to about 24%.

15 Claims, No Drawings

LIQUID SORPTIVE COATING FOR INK JET RECORDING MEDIA

The present application is a continuation-in-part of U.S. patent application Ser. No. 08/527,719, now abandoned, which was filed in the United States Patent and Trademark Office on Sep. 13, 1995, and which is incorporated herein by reference in its entirety.

FIELD OF THE INVENTION

This invention relates to a liquid sorptive coating and more particularly to a liquid sorptive coating that can be used for ink jet recording media.

BACKGROUND OF THE INVENTION

Coatings used for ink jet recording media have to meet a number of performance requirements. These requirements include dry time, color density, resolution, tack, color fidelity, lightfastness, as well as cost. For pigment based inks, ink layer cracking is also an important performance parameter. There are many materials, both organic and inorganic, that have been proposed for this application. Among them, cellulose derivatives have shown promising performance. For example, U.S. Pat. No. 4,555,437 describes a hydroxyethylcellulose coating, U.S. Pat. No. 4,269,891 describes a carboxymethylcellulose coating and a hydroxyethylcellulose coating, U.S. Pat. No. 4,575,465 and U.S. Pat. No. 5,141,797 describe hydroxypropyl cellulose, U.S. Pat. No. 4,592,954 describes a mixture of carboxymethyl cellulose and a polyethylene oxide, U.S. Pat. No. 4,092,457 and U.S. Pat. No. 4,868,581 generally mention cellulose ethers and cellulose derivatives. However, not all cellulose derivatives perform well or equally. As a matter of fact, none of the specific cellulose derivatives described in the above-referenced patents give satisfactory performance. The success of a design based on cellulose derivatives depends upon the chemical nature and physical properties of the cellulose derivatives, such as functionality. Furthermore, cellulose derivatives alone seldom offer a design that is suitable for most commercial applications. Other functional components are usually needed to achieve desired results.

SUMMARY OF THE INVENTION

The objective of the present invention is to provide a liquid sorptive coating that can be used for ink jet media. Specifically, the invention provides a hydroxyalkyl methylcellulose based liquid sorptive coating that can be used for ink jet media. The coating contains a hydroxyalkyl methylcellulose and at least one nitrogen-containing component.

The hydroxyalkyl methylcellulose used in the inventive coating preferably has a hydroxyalkyl content from about 3% to about 25%, preferably about 7% to about 12%, and a methoxyl content from about 15% to about 28%, preferably about 19% to about 24%. Further, the hydroxyalkyl methylcellulose concentration in the liquid sorptive coating is preferably from about 70% to about 98% on a weight/weight basis.

DETAILED DESCRIPTION OF THE INVENTION

The following detailed description is provided as an aid to those desiring to practice the present invention. However, it is not to be construed as being unduly limiting to the present inventive discovery, since those of ordinary skill in the art will readily recognize that the embodiments of the inventors' discovery disclosed herein may be modified using standard techniques and materials known in the art, without departing from the spirit or scope of the present inventive discovery.

The liquid sorptive coatings of the present invention can exist in the form of either a one-layer or a multi-layer structure. The liquid sorptive coating contains hydroxyalkyl methylcellulose and at least one nitrogen-containing component. The typical examples of hydroxyalkyl methylcellulose include hydroxypropyl methylcellulose, hydroxyethyl methylcellulose and hydroxybutyl methylcellulose, and the like. The hydroxyalkyl methylcellulose preferably has a hydroxyalkyl content of from about 3% to about 25%, preferably about 7% to about 12%, and a methoxyl content of from about 15% to about 28%, preferably about 19% to about 24%.

The hydroxyalkyl methylcellulose used in the present invention may, if so desired, be in the form of a mixture of different hydroxyalkyl methylcelluloses, each having hydroxyalkyl and methoxyl contents within the respective ranges set forth above. For example, METHOCEL K marketed by Dow Chemical Corp., can be advantageously used in the instant invention as a hydroxyalkyl methylcellulose. METHOCEL K possesses a hydroxypropyl content ranging from about 7% to about 12%, and a methoxyl content ranging from about 19% to about 24%.

Typical examples of the nitrogen-containing component used in the inventive coating include poly(vinyl pyrrolidone), polyamines, gelatins, quaternary polymers (such as quaternary cellulose ethers), and the like.

The liquid sorptive coatings of the present invention preferably contain about 70% to about 98% of hydroxyalkyl methylcellulose, more preferably about 80% to about 92%, on a weight/weight basis.

The thickness of the inventive coatings is not particularly restricted, but should generally be in the range of from about 2 grams per square meter to about 30 grams per square meter.

The liquid sorptive coatings of the present invention can be applied to transparent plastics, translucent plastics, matte plastics, opaque plastics or papers. Suitable polymeric materials for use as the base substrate include polyester, cellulose esters, polystyrene, polypropylene, poly(vinyl acetate), polycarbonate, and the like. Poly(ethylene terephthalate) film is a particularly preferred base substrate. Further, while almost any paper can be used as the base substrate, clay coated or polyolefin coated papers are particularly preferred as base substrate papers. The thickness of the base substrate is not particularly restricted, but should generally be in the range of from about 1 mil to about 10 mils, preferably from about 3.0 mils to about 5.0 mils. The base substrate may be pretreated to enhance adhesion of the polymeric underlayer coating thereto.

According to a preferred embodiment of the invention, the liquid sorptive coating may further comprise about 0.1% to about 15% by weight of a particulate therein based on the weight of dry coating. For example, particulates that can be used in the coating to modify the surface properties of the coating include inorganic particulates such as silica, alumina, kaolin, glass beads, calcium carbonate, titanium oxide, and the like; and organic particulates such as polyolefins, polystyrene, starch, polyurethane, poly(methyl methacrylate), polytetrafluoroethylene, and the like.

In practice, various additives may also be employed in the liquid sorptive coating. These additives are generally well-known in the art and include surface active agents that control the wetting or spreading action of the coating solutions, antistatic agents, suspending agents, and acidic compounds to control the pH of the coatings. Other additives may also be used, if so desired.

The surface of the base substrate that does not bear the liquid sorptive coating may have a backing material placed thereon in order to reduce electrostatic charge, to reduce sheet-to-sheet friction and sticking and to reduce curl, if so desired. The backing material may either be a polymeric coating, a polymer film or a paper.

Any of a number of coating methods that are well-known in the art may be employed to coat the liquid sorptive coating onto the substrate, such as roller coating, blade coating, wire-bar coating, dip coating, extrusion coating, air knife coating, curtain coating, slide coating, doctor coating or gravure coating.

The following examples are given merely as illustrative embodiments of the invention and are not to be considered as limiting. Solid content in the following Examples is presented as parts on a weight/weight basis.

EXAMPLE 1

A coating composition was prepared according to the following formulation.

| Liquid Sorptive Coating | |
|---|---|
| Hydroxypropyl methylcellulose[1] | 4.5 parts |
| Poly (vinyl pyrrolidone)[2] | 0.5 parts |
| Water | 95 parts |

[1]Dow Chemical Corporation
[2]ISP Corporation

The coating was applied to a polyester film (ICI Films) using a No. 60 Meyer rod. The liquid sorptive coating was dried at about 130° C. for about 2 minutes.

EXAMPLE 2

A coating composition was prepared according to the following formulation.

| Liquid Sorptive Coating | |
|---|---|
| Hydroxypropyl methylcellulose[1] | 5 parts |
| Cationic derivative of hydroxyethyl cellulose[2] | 1 part |
| Water | 94 parts |

[1]Hercules Chemical, Inc.
[2]National Starch and Chemical Corporation.

The coating was applied to a polyester film (ICI Films) using a No. 54 Meyer rod. The liquid sorptive coating was dried at about 130° C. for about 2 minutes.

COMPARATIVE EXAMPLE 1

A coating composition was prepared according to the following formulation.

| Liquid Sorptive Coating | |
|---|---|
| Hydroxyethyl cellulose[1] | 5 parts |
| Cationic derivative of hydroxyethyl cellulose | 1 part |
| Water | 94 parts |

[1]Hercules, Incorporated

The coating was applied to a polyester film (ICI) using a No. 60 Meyer rod. The liquid sorptive coating was dried at about 130° C. for about 3 minutes.

COMPARATIVE EXAPLE 2

| Liquid Sorptive Coating | |
|---|---|
| Carboxymethylcellulose[1] | 5 parts |
| Water | 95 parts |

[1]Hercules, Incorporated

The coating was applied to a polyester film (ICI Films) using a No. 60 Meyer rod. The liquid sorptive coating was dried at about 130° C. for about 2 minutes.

COMPARATIVE EXAMPLE 3

A coating composition was prepared according to the following formulation.

| Liquid Sorptive Coating | |
|---|---|
| Hydroxypropl methylcellulose[1] | 6 parts |
| Water | 94 parts |

[1]Dow Chemical Corporation

The coating was applied to a polyester film (ICI Films) using a No. 60 Meyer rod. The liquid sorptive coating was dried at about 130° C. for about 2 minutes.

COMPARATIVE EXAMPLE 4

A coating composition was prepared according to the following formulation.

| Liquid Sorptive Coating | |
|---|---|
| Hydroxypropyl methylcellulose[1] | 4.5 parts |
| Polyvinyl pyrrolidone[2] | 0.5 parts |
| Water | 95 parts |

[1]Hercules Chemical, Inc.
[2]ISP Corporation.

The coating was applied to a polyester film (ICI Films) using a No. 60 Meyer rod. The liquid sorptive coating was dried at about 130° C. for about 2 minutes.

Samples from each of the above Examples (and Comparative Examples) were tested for black density, ink cracking and dry time. Test results are reported in Table 1, below.

The samples were evaluated on a Hewlett Packard DeskJet 660C printer using HP 51629A and HP 51649A ink cartridges.

The black ink density was measured with a Macbeth TD 904 densitometer using the beige filter setting. The results are the average of three measurements.

The pigmented ink cracking was quantitatively rated with a numerical scale (0=worst, 5=best). When ink cracking is rated below 3, visible ink cracking is observed and the ink jet recording media are not suitable for many commercial applications.

Dry time of the image was evaluated by blotting imaged samples with Xerox 4200 copier paper. The dry time is defined by the time when no ink transfer to the paper is observed.

TABLE 1

PERFORMANCE EVALUATION OF THE COATINGS

| Examples | Hydroxy-alkyl Content | Methoxyl Content | Black Density | Ink Cracking | Dry Time |
|---|---|---|---|---|---|
| Ex. 1 | ~7% to ~12% | ~19% to ~24% | 1.8 | 4.0 | <5 Minutes |
| Ex. 2 | ~7% to ~12% | ~19% to ~24% | 1.6 | 3.0 | <5 Minutes |
| Comp. Ex. 1 | 45% | 0% | 0.9 | 1.0 | >12 Minutes |
| Comp. Ex. 2 | 0% | 26% | 1.1 | 0.0 | >12 Minutes |
| Comp. Ex. 3 | ~7.5% to ~12.5% | ~28% to ~30% | 1.29 | 1.5 | <5 Minutes |
| Comp. Ex. 4 | ~23% to ~32% | ~17% to ~20% | 1.13 | 1.5 | <5 Minutes |

The comparative testing results provided in Table 1 show that the inventive coatings disclosed herein offer an unexpectedly superior and advantageous performance in optical density, ink cracking and dry time. As a result of these properties, the coatings of the present invention offer a great impact on overall image quality and applications for ink jet recording media.

Each of the patents and publications referred to herein is incorporated by reference in its entirety.

We claim:

1. An ink jet recording medium, containing a substrate having coated on a surface thereof a liquid sorptive coating, wherein the coating contains a hydroxyalkyl methylcellulose and at least one nitrogen-containing component, wherein said hydroxyalkyl methylcellulose has a hydroxyalkyl content of from about 7% to about 12% and a methoxyl content of from about 19% to about 24%.

2. The ink jet recording medium according to claim 1, wherein said liquid sorptive coating contains about 70% to about 98% of hydroxyalkyl methylcellulose, based on the weight of solids in the coating.

3. The ink jet recording medium according to claim 1, wherein said liquid sorptive coating contains about 80% to about 92% of hydroxyalkyl methylcellulose, based on the weight of solids in the coating.

4. The ink jet recording medium according to claim 1, wherein said hydroxyalkyl methylcellulose is a mixture of different hydroxyalkyl methylcelluloses, each having a hydroxyalkyl content of about 7% to about 12% and a methoxyl content of about 19% to about 24%.

5. The ink jet recording medium according to claim 1, wherein said hydroxyalkyl methylcellulose is selected from the group consisting of hydroxypropyl methylcellulose, hydroxyethyl methylcellulose and hydroxybutyl methylcellulose.

6. The ink jet recording medium according to claim 1, wherein said nitrogen-containing component is selected from the group consisting of poly(vinyl pyrrolidone), a polyimine, a gelatin and a quaternary polymer.

7. The ink jet recording medium according to claim 1, wherein said liquid sorptive coating is a single layer.

8. The ink jet recording medium according to claim 1, wherein multiple liquid sorptive coatings are present.

9. The ink jet recording medium according to claim 1, wherein said coating further contains an inorganic particulate that is selected from the group consisting of silica, alumina, kaolin, glass beads, calcium carbonate and titanium oxide.

10. The ink jet recording medium according to claim 1, wherein said coating further contains an organic particulate that is selected from the group consisting of polyolefins, polystyrene, starch, polyurethane, poly(methyl methacrylate) and polytetrafluoroethylene.

11. The ink jet recording medium according to claim 1, wherein said substrate is a transparent plastic substrate.

12. The ink jet recording medium according to claim 1, wherein said substrate is an opaque plastic substrate.

13. The ink jet recording medium according to claim 1, wherein said substrate is a matte plastic substrate.

14. The ink jet recording medium according to claim 1, wherein said liquid sorptive coating is coated on a translucent plastic substrate.

15. The ink jet recording medium according to claim 1, wherein said liquid sorptive coating is coated on a paper.

* * * * *